United States Patent [19]

Ortiz

[11] 4,182,074

[45] Jan. 8, 1980

[54] AIRBORNE TOY

[76] Inventor: Nilson V. Ortiz, 1064 S. Van Ness Ave., San Francisco, Calif. 94110

[21] Appl. No.: 885,231

[22] Filed: Mar. 10, 1978

[51] Int. Cl.[2] ..... A63H 33/20

[52] U.S. Cl. ..... 46/86 R; 46/74 D

[58] Field of Search ..... 46/74 D, 75, 86 R, 86 A, 46/86 B, 86 C, 74 R

[56] References Cited

U.S. PATENT DOCUMENTS

| | | | |
|---|---|---|---|
| 3,055,141 | 9/1962 | Starkl | 46/86 A |
| 3,959,918 | 6/1976 | Ortiz | 46/74 D X |
| 4,034,500 | 7/1977 | Ortiz | 46/74 D X |

FOREIGN PATENT DOCUMENTS

| | | | |
|---|---|---|---|
| 539871 | 7/1922 | France | 46/86 A |

*Primary Examiner*—Russell R. Kinsey
*Assistant Examiner*—Mickey Yu
*Attorney, Agent, or Firm*—Robert K. Rhea

[57] ABSTRACT

An airborne toy comprising an inverted substantially dish-shaped body normally containing at least one rolled up toy parachute. A flexible support strand, extending through an axial opening in the body, is centrally connected with a disk underlying the body for normally supporting the toy and maintaining the rolled up parachute within the body recess. Another support strand, radially entrained across the outer surface of the body, connects the toy parachute with the first flexible strand opposite its connection with the disk for lowering the toy to the surface of the earth when airborne and the parachute has been released.

2 Claims, 5 Drawing Figures

AIRBORNE TOY

BACKGROUND OF THE INVENTION

1. Field of the Invention

The present invention relates to toys and more particularly to a toy to be airborne when thrown upwardly into the air.

2. Description of the prior art.

The most pertinent prior patent is my U.S. Pat. No. 4,034,500 which discloses a toy having a substantially saucer-shaped body provided with a recess for receiving a rolled up toy parachute behind flap doors held in closed position by the mass of the toy and parachute acting on door closing strands during launching. The toy parachute, when released while the toy is airborne, lowers the toy to the ground.

This invention is distinctive over the above named patent by providing a downwardly open dish-shaped body for containing one or more rolled up parachutes normally held within the recess of the body by a disk attached to a flexible strand extending through the body. The disk, by not being connected with the body other than by a flexible strand, releases the rolled up toy parachute from the body in an action which is quicker than is possible with the hingedly connected flap doors of the patent thus providing a greater duration of time in which the toy is supported by the parachute.

SUMMARY OF THE INVENTION

A normally inverted dish-shaped body, formed from lightweight material, is connected with a flat disk, diametrically capable of entering the recess formed by the body, by a flexible strand centrally connected with the disk and projecting through an axial opening in the body. At least one, preferably two, rolled up toy parachutes are interposed between the disk and the inner limit of the body recess. Other flexible strands, one for each parachute, are connected with the disk strand and radially entrained across the body and connected with the respective parachute shroud lines. A toy launching strand is connected with the juncture of the disk supporting and parachute strands for manually launching the toy by a whirling action. A row of circumferentially spaced openings formed in the wall of the body reduces air resistance to the toy body as it is lowered by the parachute.

The principle object of this invention is to provide an airborne toy which may be manually thrown upwardly for subsequent release of a folded or rolled up toy parachute contained by the toy to retard the descent of the toy toward the surface of the earth.

DESCRIPTION OF THE PREFERRED EMBODIMENT

Figure 1:
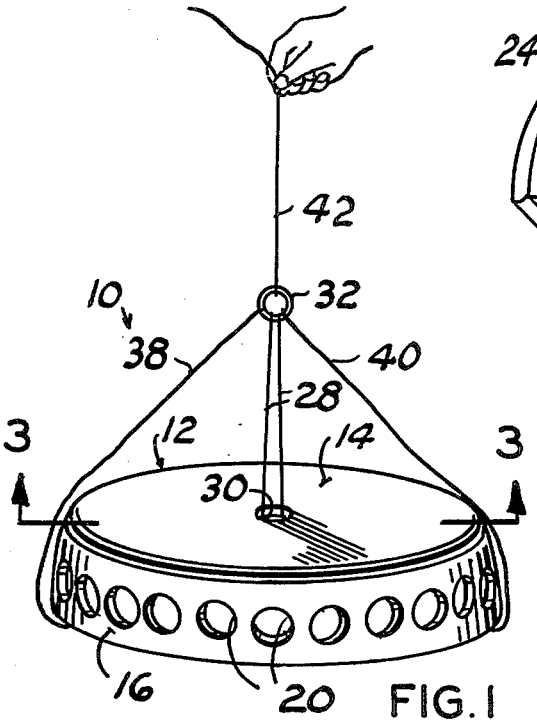
FIG. 1 is a perspective view of the toy in position to be manually thrown into flight.

Like characters of reference designate like parts in those figures of the drawings in which they occur.

In the drawings:

The reference numeral 10 indicates the toy, as a whole, comprising a dish-shaped body 12, preferably formed from lightweight material, such as aluminum, magnesium, balsa wood or plastic, which is substantially dish-shaped in general configuration. The body 12 is normally in a dish inverted position to define an upper generally flat wall 14 with its depending wall 16 defining a downwardly open recess 18. The body wall 16 is provided with a plurality of circumferentially equally spaced openings 20 for the purpose presently explained.

The toy 10 further includes a flat disk 22 diametrically slightly less than the diameter of the recess 18 for supporting one or more toy parachutes 24 and 26, when in a rolled up condition, within the recess 18 before launching the toy, as hereinafter explained.

The disk 22 is connected with the body 12 by a first flexible strand 28 entrained through suitable apertures centrally formed in the disk and extended upwardly through an aperture 30 formed in the body wall 14 with the ends of the strand 28 being connected together or secured to a ring 32, or the like. The shroud lines 34 and 36 of the respective toy parachutes are secured by flexible strands 38 and 40 to the ring 32. A launching strand 42 is also connected with the ring 32.

Operation

Figure 4:
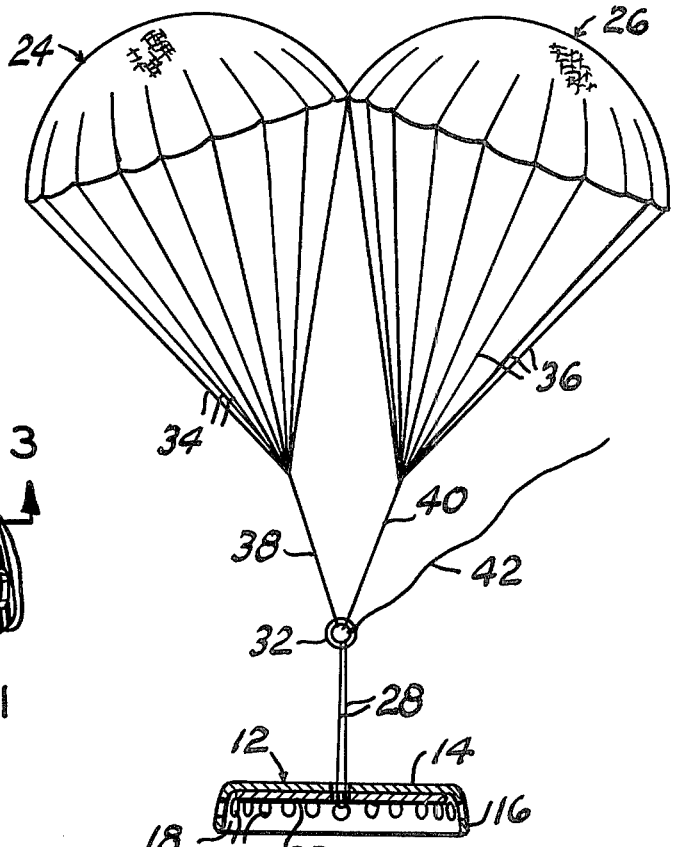
FIG. 4 is an elevational view, partially in section, illustrating the toy parachutes retarding the rate of descent of the toy; and, FIG. 5 is a vertical cross sectional view similar to FIG. 3 illustrating the relative position of the parachute supporting disk with respect to the body when only one parachute is used.
Figure 2:
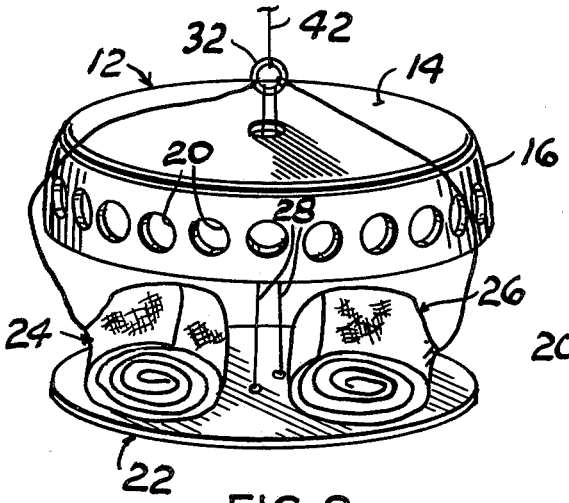
FIG. 2 is a partially exploded perspective view illustrating the relative position of a pair of parachutes contained by the toy body.
Figure 3:
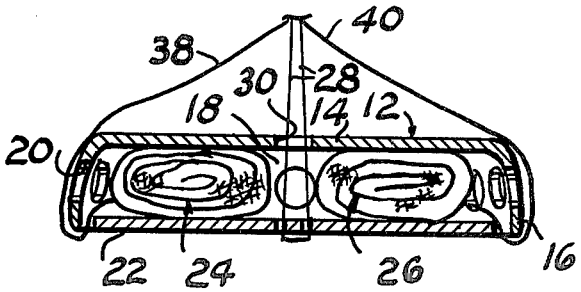
FIG. 3 is a vertical cross sectional view taken substantially along the line 3—3 of FIG. 1.
Figure 5:
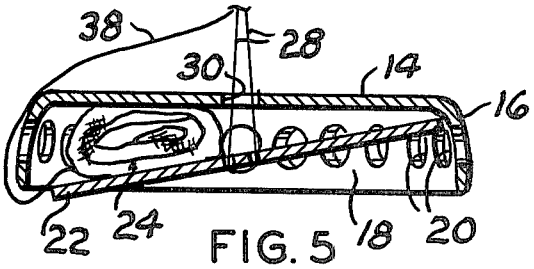

The toy parachutes 24 and 26 are manually rolled up and disposed on the surface of the disk facing toward the disk body 12 with the parachute shroud line connecting strands 38 and 40 extending radially across the outer surface of the body 12 when the toy is manually supported by the ring 32 or launching strand 42. The mass of the toy, including the parachutes, disposes the toy parachutes within the recess 18 with the plane of the disk 22 lying substantially in the plane defined by the depending limit of the body wall 16. The toy is launched by manually grasping the lauching strand 42 and manually generating a circular whirling action of the toy about an axis formed by the hand of the user with the launching strand 42 being released at a selected moment. While the toy is airborne, the parachutes are released from the confines of the recess 18 by the resistance of the material of the parachutes tending to unwind their rolled up position and by centrifugal force acting on the disk 22 thus permitting the parachutes, assisted by air resistance, to unfold to their fully open position (FIG. 4) for lowering the toy to the surface of the earth. During the parachute lowering action of the toy, the disk 22 enters the recess 18 and supports the body 12 by contact with the depending surface of the body wall 14. The openings 20 permit air flow therethrough to decrease air resistance against the toy during its descent. Obviously, only one parachute may be used, if desired, and an example of the use of only the parachute 24 is illustrated by FIG. 5 wherein the disk 22 is inclined with respect to the plane of the body wall 14 when supporting the parachute within the recess 18 prior to its being released. Similary, three or more parachutes may be employed, if desired.

Obviously the invention is susceptible to changes or alterations without defeating its practicability. Therefore, I do not wish to be confined to the preferred embodiment shown in the drawings and described herein.

I claim:

1. In an aerial toy in combination with a collapsible toy parachute having shroud lines, the improvement comprising:

an inverted substantially dish-shaped body having a downwardly open recess and having an axially apertured generally flat upper wall;

disk means including a generally flat disk of smaller diameter than the diameter of the body recess normally underlying said body and closing the recess when said toy parachute within the body recess when said toy parachute is in a rolled up condition; and, support strand means including a first elongated flexible strand longitudinally slidably extending through the body aperture for supporting said toy during launching and a second elongated flexible strand normally extending radially across the outer surfaces of said body and connected at its respective ends with the parachute shroud lines and the end portion of said first strand opposite said disk, said first strand being connected with said disk in a manner to maintain the disk in body recess closed position when the mass of the body and disk is supported via the first strand and to permit movement of said disk to a body recess open position when said body is airborne.

2. The combination according to claim 1 and further including:

a ring interposed between and secured to said first and second support strands; and, an elongated flexible launching strand secured at one end to said ring.

* * * * *